US005788018A

United States Patent [19]

Mendelsohn et al.

[11] Patent Number: 5,788,018

[45] Date of Patent: Aug. 4, 1998

[54] TRACTION ELEVATORS WITH ADJUSTABLE TRACTION SHEAVE LOADING, WITH OR WITHOUT COUNTERWEIGHTS

[75] Inventors: Arnold Mendelsohn, Simsbury; John K. Salmon, deceased, late of South Windsor, both of Conn., by Lucy Mary Salmon, executrix

[73] Assignee: Otis Elevator Company, Farmington, Conn.

[21] Appl. No.: 797,257

[22] Filed: Feb. 7, 1997

[51] Int. Cl.[6] ..... B66B 7/06

[52] U.S. Cl. ..... 187/404; 187/266

[58] Field of Search ..... 187/404, 266, 187/350, 405, 406, 411

[56] References Cited

U.S. PATENT DOCUMENTS

| | | | |
|---|---|---|---|
| 657,782 | 9/1900 | Mabbs | 187/404 |
| 664,041 | 12/1900 | Hadfield | 187/404 |
| 2,537,075 | 1/1951 | Margles | 187/266 |
| 3,101,130 | 8/1963 | Bianca | 187/244 |
| 4,716,989 | 1/1988 | Coleman et al. | 187/404 |
| 4,958,815 | 9/1990 | Ueda et al. | 187/404 |
| 5,074,384 | 12/1991 | Nakai et al. | 187/404 |
| 5,435,417 | 7/1995 | Hakala | 187/404 |

FOREIGN PATENT DOCUMENTS

| | | | |
|---|---|---|---|
| 2624-840-A | 6/1989 | France | 187/350 |

*Primary Examiner*—William E. Terrell
*Assistant Examiner*—Patrick Mackey

[57] ABSTRACT

Elevators operating in hoistways serving landings at different floor levels of multi-story buildings are each provided with a compensation or comp sheave engaged in the lower bight of the rope, at the lower end of the elevator hoistway, with all or most of the weight of the comp sheave and its bearings and support assembly being carried by the lower rope bight, providing traction and transmitting tension force to the rope. The comp sheave assembly may include a motor drive machine and brake, providing traction drive at the lower hoistway end, and the consequent tension control can replace the elevator's conventional counterweight. An adjustable comp sheave support assembly achieves tension adjustment in the rope, reducing rope tension when desired, and readily adjusting rope tension for quick releveling of the elevator to compensate for loading changes as they occur.

9 Claims, 3 Drawing Sheets

TRACTION ELEVATORS WITH ADJUSTABLE TRACTION SHEAVE LOADING, WITH OR WITHOUT COUNTERWEIGHTS

FIELD OF THE INVENTION

This invention relates to elevators for carrying passengers and freight installed in vertical elevator shafts or hoistways, and particularly to such elevators employing no counterweight but relying instead upon a traction drive sheave to counteract the tendency of the elevator car to descend, impelled by the force of gravity.

BACKGROUND OF THE INVENTION

Conventional elevators normally employ counterweights connected by cables or drive ropes to the elevator car, to counterbalance the average weight of the car and its normal load, minimizing the torque required to turn a traction drive sheave and cause the elevator to rise or descend in its normal travel. The counterweight nearly doubles the system mass and therefore nearly doubles the system kinetic energy to be added and removed from the system on each run of the car. The counterweight also performs a second function in maintaining the cable tension needed in the system to permit the traction drive sheave to drive the elevator without slipping.

A third function of the counterweight is to minimize the releveling adjustment required as passengers leave the elevator car, reducing the car's gross weight and causing it to tend to rise in the elevator shaft. Releveling is a complex operation, creating the possibility of serious damage or injury unless malfunctions are carefully avoided.

The use of a flywheel in an elevator drive system to provide an energy storage unit has been proposed, and such flywheel systems can eliminate the need for a second expensive energy storage device, the counterweight. Flywheel systems reduce the kinetic energy of the system by eliminating a significant portion of the mass which must be accelerated for every elevator run. When such systems are built without a counterweight, this also eliminates the use of counterweight rails, a counterweight buffer and tie down compensation. However, a larger drive motor or "machine" is needed because of the additional torque required to move the unbalanced weight of the elevator car itself on its upward run and to maintain tractive control of its position throughout its upward and downward runs.

In counterweighted elevators, the upper bight of the elevator cable or "rope" carrying the full weights of the elevator car and its counterweight is called the hoist rope, and the lower bight of the rope connecting the undersides of the counterweight and the elevator car, normally carrying only its own weight, is called the compensation or "comp" rope, which may be lighter than the hoist rope to compensate for the additional weight added to that of the elevator car by the travelling cable weight near the upper end of the elevator shaft, the travelling cable being the conventional means for connecting elevator car control systems, lights, communication and air conditioning power from the central portion of the shaft to each elevator car.

When the lower bight comp rope connects the lower end of a counterweight to the underside of the elevator car and the upper bight hoist rope connects the upper end of the counterweight over top sheaves to the upper end of the elevator car, different and heavier sizes and weights of hoist ropes are conveniently employed. When no counterweight is used, however, a cable splice connection between the hoist rope and the lighter comp rope would be required and this adds additional complication, making a continuous hoist rope running from the car top around the system to the car bottom preferable in counterweightless elevator systems. The travelling cable weight is not compensated at all, but the system is mechanically far simpler.

DISCLOSURE OF INVENTION

The counterweightless elevator systems of this invention all employ such a continuous hoist rope, with a comparatively heavy compensation sheave rotatably mounted at the lower end of the elevator shaft or hoistway, engaging the lower "comp" bight of the drive rope, with the weight of the compensation sheave and its associated journal bearing support assembly being substantially or completely carried by the drive rope, thereby applying traction force to the rope itself sufficient to hold the elevator car at any desired position, and also when desired to drive it in an upward or downward direction when torque is applied to the compensation sheave.

With the traction drive systems of the present invention, the heavy compensation sheave installed at the bottom of the elevator hoistway may thus serve as the drive sheave, with the "machine"—the drive motor and the reversing gearbox, the brake and associated power and control units—being mounted on a single bedplate positioned at the bottom of the elevator hoistway. All these units provide the total weight applied through the compensation sheave to the comp bight portion of the elevator hoist rope, to maintain the car at any desired level and to drive it up and down in its normal path of travel. This is an efficient arrangement, since the sheave must provide ample weight for the traction drive, and the mass of the machine provides a free source of the dead weight needed to maintain traction.

Passive Compensation

The passive compensation sheave system just described requires that the compensation sheave's effective weight must be large enough to drive the fully loaded car at the highest traction force level needed without slipping the ropes. This subjects the ropes and sheave bearings to a larger load than necessary at almost all other times, when the car is not fully loaded and when it is stationary, being held at a particular level by its safeties clamping it in any predetermined position, normally at predetermined floor levels.

Conventional traction drive elevators employing counterweights utilize the counterweight to perform two functions: to counterbalance the elevator car weight and reduce the torque required and the peak potential power required to lift the elevator and its load, and also to provide hoist bight tension on the side of the traction sheave opposite to the car side required to develop traction between elevator hoist rope and drive sheave. The compensation sheave supplies an incidental component of the necessary hoist bight tension, because the main source of this tension is the counterweight.

During passenger unloading of such counterweighted elevators, the reducing passenger load on the elevator car may cause it to lift as the hoist rope tension lessens, and the procedure of lifting the brake and releveling the car by torque delivered by the machine may be a difficult operation. Eliminating this set of operations increases the safety and the reliability of the elevator.

Active Compensation

Elastic releveling of the elevator car at each landing during unloading may be achieved without such procedures by the adjustment of the compensation sheave weight in the active compensation systems of the present invention. These systems automatically sense the diminishing weight and consequent diminishing tension in the compensation bight of the elevator hoist rope and automatically adjust the variable weight of the compensation sheave and associated units to counteract such diminishing tension without lifting car brakes or operating the drive motor to reduce small increments of lift or sag movement for the car. Adjustment is achieved by variable force rams acting upward on the comp sheave drive machine, reducing the traction sheave loading of the comp bight of the hoist rope upon command.

Accordingly, a principal object of the present invention is to provide smooth reliable elevator acceleration, travel and deceleration while leveling the elevator car at each landing and maintaining the leveled position of the car during loading and unloading, all with maximum efficiency.

A further object of the invention is to provide such elevator operation without requiring the use of a counterweight by employing a compensation sheave in the lower bight of a continuous elevator hoist rope running from the car top over the sheaves at the top of the elevator shaft, down around the compensation sheave at the bottom of the shaft and back up to the car frame.

A further object of the invention is to provide such elevator systems incorporating supplemental adjustable support means such as adjustable rams adapted to carry a portion of the weight of the compensation sheave and all of its associated devices and units whereby the full weight of the compensation assembly may be delivered to and carried by the compensation bight of the elevator cable, or a substantial portion of that weight may be assumed by the supplemental support system, significantly reducing the tension loads carried by the elevator hoist rope, reducing wear and tear on the rope, the sheaves and the machine units by utilizing lower torque loads to move and control the position of the elevator car.

Still another object of the invention is to provide such elevator systems employing at least two hydraulic ram cylinders as the supplemental support means for the compensation sheave and all associated units, and controlling the ram pressures in these cylinders to maintain suitable forces for any condition of the elevator system.

A further object of the invention is to provide such elevator systems employing supplemental hydraulic ram support for the compensation sheave assembly incorporating a normally open valve between the cylinder supply conduit and the hydraulic fluid sump tank, assuring a fail safe condition in the event of power loss to the hydraulic system. The loss of pressure eliminates the supplemental support, applying the full weight of the compensation sheave assembly and creating the maximum tension needed to prevent slipping and to control all elevator positions in the power loss condition.

Yet another object of the invention is to provide such elevator systems utilizing the adjustable supplemental support system as a weighing device to provide load information, and based upon such load weighing information, to apply the appropriate loads in acceleration and steady state to meet optimum performance values.

Other objects of the invention will in part be obvious and will in part appear hereinafter.

The invention accordingly comprises the features of construction, combinations of elements, and arrangements of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description taken in connection with the accompanying drawings, in which.

BEST MODE FOR CARRYING OUT THE INVENTION

The adjustable weight compensation sheaves of the present invention are useful with both conventional counterweighted elevators and also with counter-weightless elevators. They provide a highly efficient drive system and releveling operation for counterweightless elevators, whether the machine is positioned in the conventional location at the top of the elevator shaft as indicated in FIG. 2, or is combined with the comp sheave in a unitary assembly at the bottom of the elevator shaft as shown in FIG. 1, where it is easily accessible to electrical power connections and eliminates the need for machine rooms at the head of the elevator shaft, which require a significant volume of rental space; this can then be offered to tenants occupying the building on its more desirable upper floors.

Figure 1:
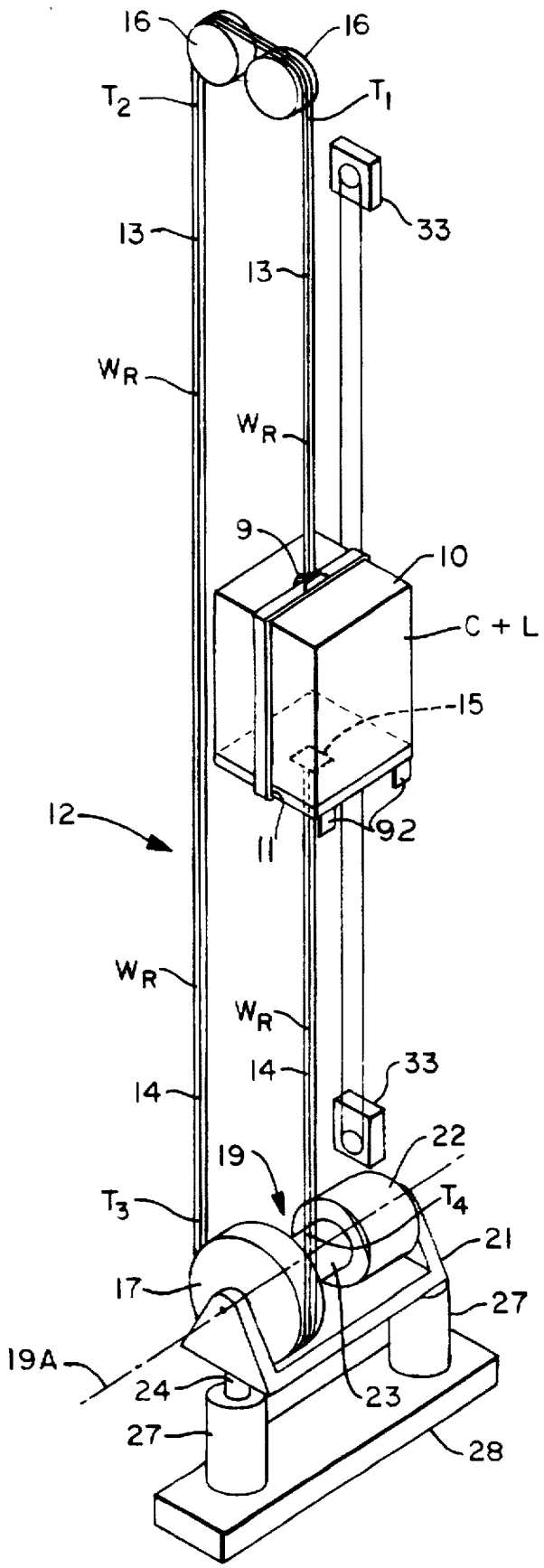
FIG. 1 is a perspective schematic view of an elevator car and its hoist rope incorporating no counterweight, with a compensation sheave and drive motor machine assembly positioned at the bottom of the elevator shaft, and with a supplemental support system adjustable to change the weight of the compensation sheave assembly applied to the elevator hoist rope with only elevator car-supporting idler sheaves positioned at the top of the elevator shaft.

The schematic diagram of FIG. 1 shows a counterweightless elevator with a continuous hoist rope extending upward from the upper car frame around two idler sheaves at the top of the elevator shaft, and thence downward around a large compensation sheave, shown mounted with its drive motor and associated gear-box, brake and other units assembled together on a single bedplate, with the hoist rope then ascending to the underside of the car frame. The elevator car 10 carried by frame 11 is thus suspended from hoist rope 12 whose upper bight ascends from a crosshead hitch plate 9 on frame 11 to the idler sheaves 16 and then descends to pass around comp sheave 17, then returning upward to a safety plank rope hitch 15 on the underside of the elevator car frame 11. The upper bight of hoist rope 12 passing over idler sheaves 16 may be identified as bight 13 while the lower bight of hoist rope 12 passing around the comp sheave 17 may be identified as the lower comp bight 14 of hoist rope 12. Traveling cable 18 connecting the car to the electrical power system of the building is shown at the right side of FIG. 2.

The adjustable comp sheave assembly 19 illustrated at the lower end of FIG. 1 is shown mounted for rotation about a horizontal axis 19A on a single bedplate 21 which thus carries the drive motor 22, the gearbox 23 and all related brake, clutch or transmission units required to complete the "machine" controlling comp sheave 17 in the adjustable assembly 19. The weight of the entire assembly 19 is transmitted by comp sheave 17 to the comp bight 14 of hoist rope 12.

Figure 2:
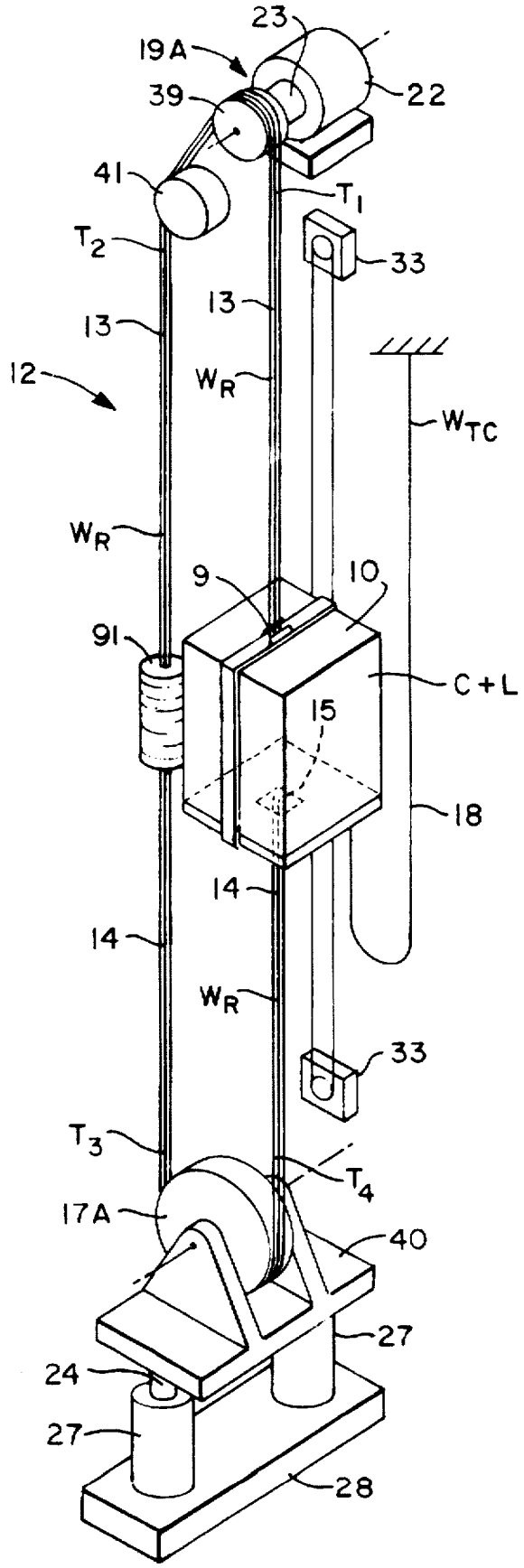
FIG. 2 is a comparable perspective schematic view showing an elevator system having no counterweight with a compensation sheave positioned at the bottom of the elevator shaft having similar adjustable, supplemental support systems, but with the elevator traction drive sheave and drive motor machine mounted in the conventional position at the top of the elevator shaft.
Figure 3:
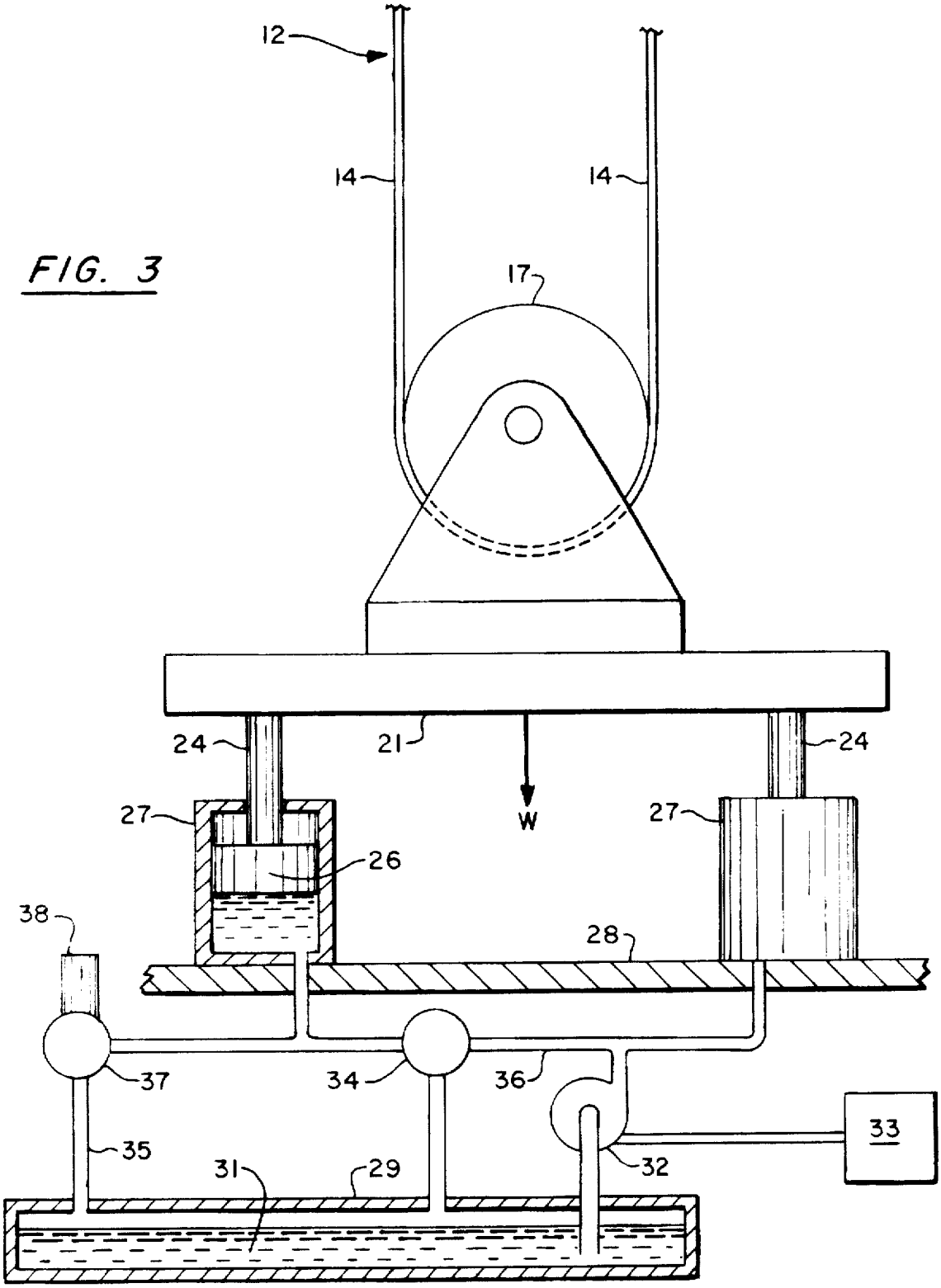
FIG. 3 is an enlarged fragmentary elevation schematic view of the compensation sheave mounted at the lower end of the elevator shaft engaged in the compensation bight of the elevator rope, and with the weight of the compensation sheave and machine assembly being carried by the rams of two hydraulic cylinders supplied with hydraulic fluid by a pump from a sump tank, with an overpressure relief valve interposed in the system and with a failsafe solenoid-type control valve normally maintained closed by electric power, and automatically opened whenever a power loss occurs, reducing hydraulic pressure in the hydraulic cylinders and returning pressurized hydraulic fluid directly to the sump tank to apply maximum compensation sheave assembly load to the compensation bight of the elevator cable.

The adjustable supplemental support assembly for the bedplate 21 and all units carried on it, employed in the preferred embodiments of the invention, is shown at the lower end of FIGS. 1 and 2, and in the enlarged detailed schematic view of FIG. 3. In these FIGURES, rams 24 are shown supporting bedplates 21 or 40, protruding upward from the hydraulic cylinders 27. Rams 24 form the unitary upper end portions of pistons 26, each movably positioned for reciprocating vertical movement in a cylinder 27.

The lower ends of each cylinder 27 are solidly anchored to a supporting deck 28 seated with ample footings on the building support structure, such as bed rock. A sump tank 29 shown at the bottom of FIG. 3 provides a reservoir of hydraulic fluid 31 and the motor driven pump 32 controlled by automatic weighing and position sensing governor systems 33 is operated as required. Pump 32 delivers hydraulic fluid 31 through a conduit 36 to the lower ends of the hydraulic cylinders 27, causing pistons 26 to rise, moving rams 24 upward, raising the bedplate 21.

This reduces the tension in comp bight 14 of hoist rope 12 since the rope does not carry the entire weight of comp sheave 17 and its overall assembly 19; part of this weight is now carried by the rams 24 and support deck 28. An over pressure relief valve 34 in the pressurized fluid delivery conduit 36 is set at a predetermined value to assure that the minimum load applied by comp sheave 17 to comp bight 14 of rope 12 is not reduced below a predetermined minimum value. In addition, a solenoid valve 37 is normally held closed by solenoid 38 connected to line power. In the event of a power failure, however, the solenoid is de-energized, allowing the valve to spring open, draining pressure from pressurized hydraulic fluid 31 from cylinders 27 through conduit 36 and a drain line 35 into sump tank 29. This reduces the upward force delivered by rams 24 to support bedplate 21 and thereby increases to its maximum the load applied to lower comp bight 14 by the comp sheave, the associated components forming the machine and the bedplate 21. This assures that so long as the power failure continues the tractive force applied by the hoist rope 12 on comp sheave 17 will be counteracted by the normal failsafe braking force applied by the machine as well as the stalled drive motor, assuring that the elevator car will not descend until power is restored and control is returned to the drive mechanism.

In the comparable schematic diagram of FIG. 2, the elevator car 10 supported by frame 11 is again suspended on a single hoist rope 12 which may incorporate a plurality of strands of cable extending upward from the upper portion of the elevator car frame 11 over sheaves positioned at the top of the shaft. The hoist rope then extends downward to the bottom of the shaft, where a comp sheave **17*a* is suspended in the comp bight 14 of the hoist rope 12 in the same manner that comp sheave 17 is suspended there in the shaft of FIG. 1**.

In FIG. 2, however, the drive motor and associated parts forming the machine are all located at the upper end of the shaft where machine **19*a* is seen to include motor 22, brake and gearbox 23, a traction drive sheave 39 and a deflector sheave 41. The traveling cable 18 is shown in FIG. 2 and a car position encoder combined with governor rope and governor 33 are likewise positioned in the same way in both FIGS. 1 and 2**.

In FIG. 2, since the drive motor "machine" assembly and bedplate are all mounted in stationary fashion at the top of the elevator shaft, the weight of these components is not applied to tension the hoist rope. Instead, the comp sheave **17*a* and its bedplate support frame 40 provide the sole traction load W in FIG. 2. This traction load W delivered by the comp sheave 17*a* to the hoist rope 12 is adjustable through rams 24 and cylinders 27 in the same fashion as the greater weight of comp sheave 17 and the entire machine assembly 19 is delivered by comp sheave 17 to hoist rope 12 in FIG. 1**, subject to the same adjustability.

The traction loads transmitted by the hoist rope from the drive sheave or comp sheave to move the elevator car and hold it in position create rope tension in the hoist rope, and the tension at the particular points in the continuous hoist ropes shown in FIGS. 1 and 2 are identified as T1, T2, T3 and T4.

T1 is the tension in the hoist rope above the elevator at the overlying sheave where the hoist rope changes direction. T2 is the tension in the hoist rope on the opposite side of the upper bight 13 at the point where the hoist rope extends downward from overlying sheave 16 and 41. T3 is the rope tension in the same straight run of hoist rope directly below the overlying sheave 16 or 41 at the lower end of FIGS. 1 and 2, just above the comp sheave 17 or **17*a*. T4 is the tension at the opposite side of lower comp bight 14 of the hoist rope 12 just above comp sheave 17 or 17*a*, from which point the hoist rope extends upward to the underside of the car frame 11**.

The following calculations show first the definition of the various weight and force values taken into account in determining these tensions and their significance in controlling the movement and the positioning of the elevator. Thus, h designates the total rise or vertical height of the hoistway from bottom to top while y indicates the vertical position or car height of the elevator car 10 above the lower end of the hoistway. The TR or traction drive force may be called the available traction or the "traction relation"; and it is determined in each case for the two counterweightless elevators shown in the Figures by the following calculations:

TABLE I

Tensions in a Counterweightless Elevator System

Tensions with Drive at Top (FIG. 2)

$T_1$ is always greater than $T_2$
C + L = gross weight of car and load
$W_R$ = rope weight, per foot
W = comp sheave downward force applied to rope
$W_{TC}$ = weight of traveling cable, per foot
a = upward acceleration of car
y = car height  h = rise $$T_1 = \left(1 + \frac{a}{g}\right)\left(W_R(h - y) + C + L + W_{TC}\left(\frac{y}{2}\right) + W_R y\right) + \frac{W}{2}$$

$$T_2 = \left(1 - \frac{a}{g}\right)(W_R h) + \frac{W}{2}$$

TABLE I-continued

Tensions in a Counterweightless Elevator System $$T_3 = T_4 = \frac{W}{2}$$

TR = Traction Drive Force $$TR = \frac{T_1}{T_2} = \frac{\left(1+\frac{a}{g}\right)\left(W_R h + C + L + W_{TC}\left(\frac{y}{2}\right)\right) + \frac{W}{2}}{\left(1-\frac{a}{g}\right)W_R h + \frac{W}{2}}$$

Tensions with Drive at Bottom (FIG. 1)

$$T_1 = T_2 = (W_R h + C + L)\left(1+\frac{a}{g}\right)$$

$$T_3 = T_2 - W_R h\left(1-\frac{a}{g}\right)$$

$$T_4 = \frac{W}{2}$$

TR = Traction Drive Force $$TR = \frac{T_3}{T_4} = \frac{(W_R h + C + L)\left(1+\frac{a}{g}\right) - W_R h\left(1-\frac{a}{g}\right)}{\frac{W}{2}}$$

Examination of the foregoing calculations shows that the tension needed to prevent slippage of the hoist rope on the drive sheave or comp sheave varies with rise, h, the car load, L, the car weight, C, the rope weights, $W_R$ and $W_{TC}$, the car position, y, the acceleration, a, the direction of travel and the available traction relation. The compensation sheave force W needed to provide nonslip operation varies widely at different conditions. At times it may be significantly lower than the maximum value which would be required for the passive compensation described above. Maintaining the maximum tension at all times punishes the system mechanically.

If the tension is controlled, the wear and tear can be reduced by lowering tension whenever it is not needed for performance. The rope, sheave, and bearing lives of these elevator installations can be conserved and extended in a number of ways through the use of the adjustable ram support system. If electrical load-weighing transducers or micro-switches are employed, the compensating sheave loading system can provide load weighing information. This information can be employed to select the appropriate loads in acceleration and steady state operation to meet optimal performance values, as well as facilitating the releveling operation described below. Maximum tension is employed during acceleration and deceleration of the elevator car, corresponding to the dynamic tension needed for full load operation during a steady state run, and when the elevator car is stopped, the tension applied may be that needed for a fully loaded elevator car at rest.

Elastic Releveling

Counterweighted elevators compensate for slight car lift and car sag as passengers leave the elevator car and new passengers board, by lifting the brake and applying machine power to relevel the car at each landing. When passengers board the car, the hoist rope tension increases since a greater cargo load is now being carried by the hoist rope and the car sags slightly below the landing level, as the hoist rope lengthens by elastic deformation. When passengers leave the car, the hoist rope tension is reduced and the rope is shortened by normal elastic deformation, causing the car to lift slightly. The elasticity of the hoist rope and the hitch joining it to the elevator car frame is the source of this slight sag or lift movement of the car.

In order to solve this problem using the systems of the present invention, as the car reaches a floor landing some tension is applied by the comp sheave as the car levels and the machine stops and the brake is applied. As passengers leave and the car tends to rise, this is detected by the load weighing units 92, causing solenoid 38 to be de-energized briefly, with solenoid valve 37 thus releasing some hydraulic fluid from each cylinder 27 to return it to sump tank 29. This slightly lowers the bedplate 21 and increases the load of comp sheave 17 and all associated units which is thus applied to comp bight 14 of hoist rope 12. The resulting slight extension of the rope 12 allows the elevator car to sag slightly and counteracts the lift resulting when the departing passengers leave the car.

If the elevator car sags below floor landing level when a number of passengers board, the opposite adjustment can be made very quickly with the load weighing units triggering pump 32 to supply additional hydraulic fluid 31 to cylinders 27, raising bedplate 21. This reduces the comp sheave load applied to hoist rope 12, allowing the car to lift and thus counteract the sag caused by passengers boarding. This compensation can be performed so quickly that the slight car level change caused by the arrival or departure of a single passenger may be counteracted immediately, even before a second passenger arrives or departs in many cases. The elevator brake and the machine motor have not been required to perform any function in this automatic tension adjustment operation, producing the elastic releveling desired merely by slightly raising or lowering bedplate 21.

By changing hydraulic pressure in cylinders 27 until the car is leveled, the system is merely adding or removing a tension force equal to the change in car load for which compensation is desired. By monitoring this pressure, load changes can be identified and passenger movement at each stop can be estimated. These changes can be factored into the elevator dispatching algorithms as desired.

Elastic releveling compensation can be used with or without counterweights 91. The conventional counterweighted systems can use the same designs for tie down against jump, and traction augmentation. The non counterweighted elevator system needs hydraulic cylinders for traction, but has no car or counterweight jump problem.

It will thus be seen that the objects set forth above, and those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An elevator system including an elevator car having a car frame adapted for travel within a hoistway between landings on different floors of a multi-story building, comprising:

a top sheave, mounted for rotation about a first horizontal axis at the upper end of said hoistway, a compensating comp sheave mounted for rotation about a second horizontal axis at the lower end of said hoistway, a continuous hoist rope having a first end anchored to a central crosshead hitch plate anchored to the top of said car frame and extending upward over said top sheave rim forming a top bight and thence along a downward run and around a lower rim portion of said comp sheave, forming a lower comp bight, and thence again extending upward to a second end of said hoist rope anchored to a safety plank rope hitch anchored to the bottom of said car frame;

a deflector idler top sheave positioned in tangent engagement with said hoist rope for rotation about a third horizontal axis adjacent to and substantially parallel to said first horizontal axis at the upper end of said hoistway, with the first and third horizontal axes being spaced apart and deflecting the downward run of said hoist rope to a path clearing all other structures in the hoistway, said comp sheave being journalled on a supporting bedplate, a reversible drive motor machine including an electric motor operatively connected to apply traction force to tension said hoist rope, producing acceleration, deceleration and normal traversing movement of the elevator car upon command, with a reversing gear-box transmission and a brake operatively connected to the drive means, said motor, gear-box transmission and brake of said drive means forming a machine governing the changes in position of the elevator car, and vertically movable ram means positioned beneath said bedplate and connected thereto to apply adjustable lifting force raising the bedplate and thereby reducing the weight of the bedplate and the comp sheave journalled thereon which is delivered by the comp sheave rim to said hoist rope lower comp bight.

2. The elevator system defined in claim 1, wherein the machine is stationary and positioned at the top of the hoistway and is operatively connected to deliver to said top sheave braking torque and driving torque in either direction upon command.

3. The elevator system defined in claim 1, wherein the machine is positioned at the bottom of the hoistway, mounted on said bedplate and is operatively connected to deliver to said comp sheave braking torque and driving torque in either direction upon command.

4. The elevator system defined in claim 1, further including a counterweight vertically reciprocable in said hoistway and interposed in said downward run of the hoist rope, said hoist rope being divided into too halves substantially equal in length, an upper half forming the top bight and connecting an upper end of the counterweight to said elevator car crosshead hitchplate, and a lower half forming the lower comp bight and connecting the opposite lower end of the counterweight to said safety plank rope hitch.

5. The elevator system defined in claim 1, further including an underlying support deck spaced beneath said bedplate, and wherein said ram means include two hydraulic cylinders mounted on said support deck with vertically reciprocable pistons respectively positioned in said cylinders, each piston carrying an upwardly projecting ram connected to deliver vertical lifting force to the bedplate, and a source of hydraulic fluid including a sump tank and a pump conduit-connected to the sump tank and to each hydraulic cylinder, with a valve-controlled drain conduit connected to the cylinders and the sump tank, whereby said pistons are raised by hydraulic fluid delivered by said pump to said cylinders, lifting the bedplate and reducing the portion of the weight of the comp sheave and the bedplate carried by the hoist rope comp bight, and whereby said pistons are lowered when said drain conduit returns fluid to the sump tank, increasing the portion of the weight of the comp sheave and bedplate carried by the hoist rope comp bight.

6. The elevator system defined in claim 5, wherein the machine is positioned at the bottom of the hoistway, mounted on said bedplate and is operatively connected to deliver to said comp sheave braking torque and driving torque in either direction upon command.

7. The elevator system defined in claim 5, further including automatic control means releasing the brake and actuating said pump to reduce the weight delivered by the comp sheave to the hoist rope when the elevator car is stationary, and opening said drain conduit valve alternately to increase said weight to facilitate traction drive of the hoist rope by the machine when required to move the elevator car on a run to another floor landing.

8. The elevator system defined in claim 5 wherein said drain conduit is controlled by a solenoid valve normally held closed by its energized solenoid, providing a failsafe drain connection of said hydraulic cylinders to said sump tank if a power failure interrupts the electric power energizing the solenoid.

9. The elevator system defined in claim 7, further including load weighing units delivering output signals indicating increases and decreases in the live load of passengers and cargo boarding and leaving the elevator car, and control means connected to receive all such output signals and to respond thereto by actuating the pump and energizing the solenoid to decrease hoist rope tension, thus counteracting sag of the elevator car below a landing caused by increased live load, and alternatively by stopping the pump and de-energizing the solenoid to increase hoist rope tension, thus counteracting lift of the elevator car above a landing caused by decreased live load, whereby releveling of the car is automatically achieved continuously as needed.

* * * * *